United States Patent [19]

Scott et al.

[11] 4,398,316

[45] Aug. 16, 1983

[54] SPEED SELECTOR SWITCH

[75] Inventors: Ernest R. Scott, Mayfield Heights; Raymond J. Strnad, Avon, both of Ohio

[73] Assignee: The Scott & Fetzer Company, Westlake, Ohio

[21] Appl. No.: 339,107

[22] Filed: Jan. 13, 1982

[51] Int. Cl.[3] ..... A47L 9/28

[52] U.S. Cl. ..... 15/332; 15/339

[58] Field of Search ..... 15/319, 332, 334, 339; 307/139; 200/52 R

[56] References Cited

U.S. PATENT DOCUMENTS

| | | | |
|---|---|---|---|
| 2,072,690 | 3/1937 | Smellie | 15/314 X |
| 3,319,282 | 5/1967 | MacFarland | 15/319 |
| 3,467,980 | 9/1969 | Golloway | 15/332 X |
| 4,329,757 | 5/1982 | Ramstrom et al. | 15/324 |
| 4,336,626 | 6/1982 | Hone et al. | 15/319 |

*Primary Examiner*—Chris K. Moore

*Attorney, Agent, or Firm*—Pearne, Gordon, Session, McCoy, Granger & Tilberry

[57] ABSTRACT

An electrical switch mechanism for energizing and varying the speed of a vacuum cleaner motor is responsive to the particular interchangeable cleaning attachment mounted on the housing of the vacuum cleaner. Fixed and movable electrical contacts of the switch mechanism are enclosed within and protected by the housing. A spring-biased linkage element connected to the movable contact passes through a wall of the housing and engages with one end of a multiposition cranklike linkage element pivotably fixed on that face of the housing supporting a cleaning attachment. Each attachment includes a switch-activating lug engageable with the other end of the cranklike element to move the movable contacts, via the linkage elements, from a normal open circuit position to one or the other of two closed circuit motor energizing positions.

8 Claims, 6 Drawing Figures

SPEED SELECTOR SWITCH

BACKGROUND OF THE INVENTION

The present invention relates in general to electrical switch mechanisms, and in particular to a multiposition speed selector switch assembly actuated by interchangeable cleaning attachments coupled to the suction motor housing of a domestic vacuum cleaner.

Multifunction vacuum cleaners having a plurality of interchangeable cleaning attachments and other work attachments, such as air driven tools, are known in the art. It is further known to provide such vacuum cleaners with an electrical switch mechanism responsive to the positioning and securing of each attachment on the housing of the suction motor. Without an attachment coupled to the housing, the electrical switch mechanism maintains an open circuit condition to preclude inadvertent energization of the suction generating motor. When an attachment is secured to the motor housing, the attachment engages and activates the switch mechanism to move it to one of two motor speed determining positions. For example, a carpet cleaning attachment requires low speed suction motor operation, while a hard surface cleaning attachment requires high speed motor operation.

U.S. Pat. No. 3,319,282, assigned to the assignee of the present invention and incorporated in its entirety by reference herein, illustrates and describes a custom designed switch for performing the functions noted above. The disclosed switch is mounted on the external face of the suction motor housing engageable with associated attachments. While the '282 patent illustrates a switch mechanism having two separate actuating push buttons it is further known to utilize a single push button multiposition switch in place of the two push button switch illustrated.

It has been found that, while the switch illustrated in the '282 patent adequately performs the earlier noted functions, it is susceptible to infiltration by dirt and dust particles that can interfere with the electrical continuity between the switch contacts and with the mechanical movement of associated switch elements. Further, the noted prior art switch assembly, because of its custom design and complexity, is costly. Also, the switch elements which carry high current electric power are located on the exterior of the suction motor housing, thus being subjected to abuse wherein breakage of the switch housing could expose a user to an electrical shock hazard.

SUMMARY OF THE INVENTION

In accordance with the present invention, a switch is mounted within the suction motor housing of a vacuum cleaner, the switch having fixed and movable contacts. A linkage means is connected to the movable contact or contacts of the switch. The linkage extends through the motor housing wall for engagement with a work attachment mounted on an exterior face of the housing. The position of that portion of the attachment engageable with the linkage means determines the position of the switch means wherein the state of energization of the motor is dependent on the position of the switch. Preferably, the linkage mechanism is spring-based to maintain the switch in an open circuit condition when no attachment is mounted on the housing to preclude inadvertent energization of the suction motor. The location of the electrical switch within the motor housing advantageously protects it from dirt and dust, and from abuse. The switch preferably is a standard multiposition, double pole, slide switch adapted to interface with the linkage in the preferred form of an elongated arm element within the housing connected to a cranklike lever pivotally mounted on the exterior face of the housing supporting an attachment. The invention provides a switch mechanism that is highly reliable and rugged, while being easier to manufacture and less costly than prior art devices performing the same function.

A fuller understanding of the invention may be had by referring to the following description and claims, taken in conjunction with the accompanying drawings.

DETAILED DESCRIPTION OF THE PREFERRED EMBODIMENT

Figure 1:
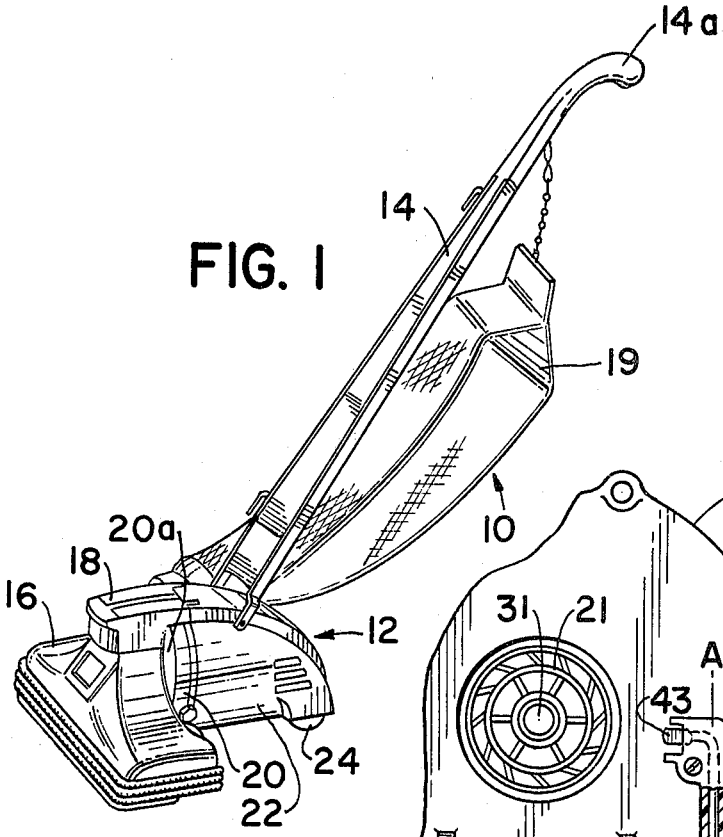
FIG. 1 is a perspective view of an upright vacuum cleaner incorporating the present invention.

With reference to FIG. 1 of the drawings, there is illustrated a domestic vacuum cleaner 10 of the well-known upright type. The cleaner 10 includes a wheel-supported suction motor housing 12 having a fan casing 20 and a motor casing 22. A removable work attachment in the illustrated form of a rug cleaning nozzle 16 can be releasably mounted on the vertical front wall or exterior face 20*a* of the fan casing 20. The nozzle 16 is of conventional design and includes a rotating brush assembly (not shown) belt driven from a drive shaft 31 (see FIGS. 2 and 3) rotatably supported within the housing 12. As further illustrated in FIG. 1, a conventional floor light hood 18 (pivotally mounted for upward movement as illustrated in FIG. 3) projects light downwardly in front of the nozzle 16 during operation of the vacuum cleaner 10 to illuminate the cleaning path over which the vacuum cleaner 10 is pushed and pulled by the user. An upwardly extending handle structure 14 terminates in a hand grip portion 14*a* which is gripped by the user in manipulating the vacuum cleaner 10 during cleaning or other working operations. As noted earlier, the nozzle 16 is one example of work attachments that can be mounted on the suction motor housing 12 of the vacuum cleaner 10. Other interchangeable work attachments can be substituted in place of the nozzle 16, as is well-known in the art. In utilizing the cleaning nozzle 16 or another vacuuming type attachment, a dirt and dust collecting bag 19 is attached to a tangential outlet (not shown) of the fan casing 20 and is suspended from the handle structure 14 as illustrated.

Figure 2:
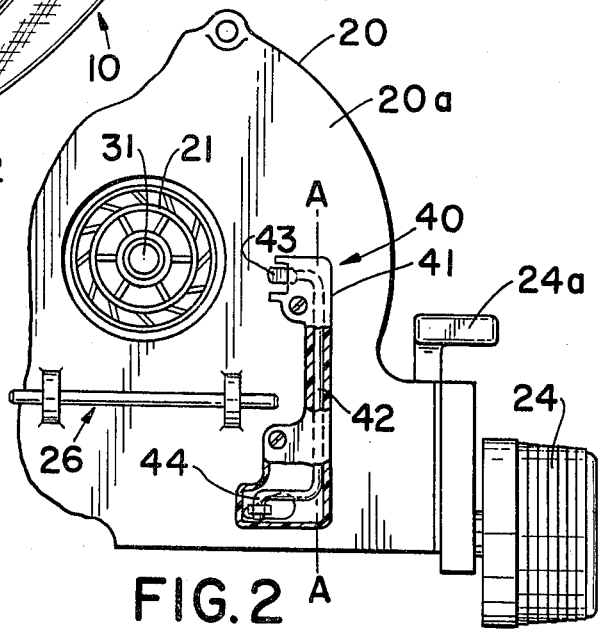
FIG. 2 is a sectional front view of the vacuum cleaner housing without a cleaning attachment mounted to it.
Figure 3:
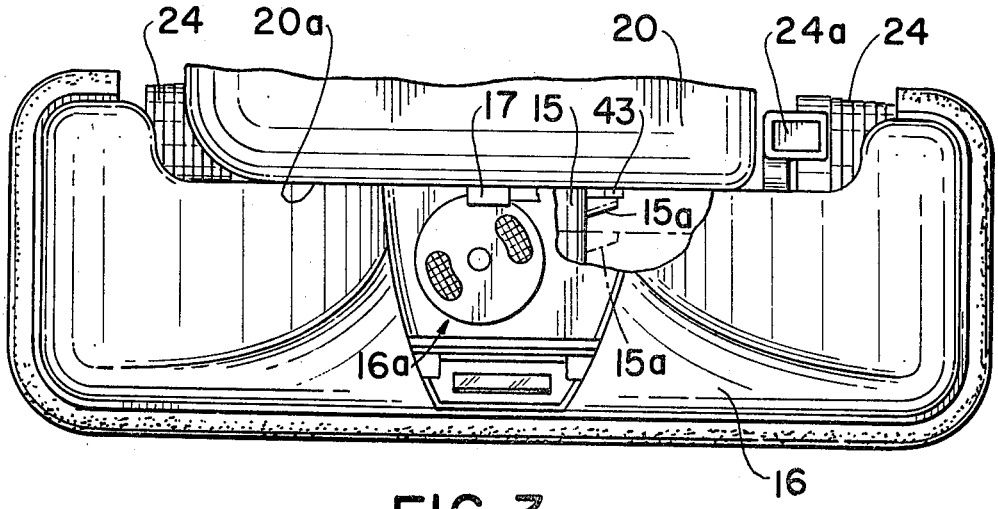
FIG. 3 is a sectional plan view with portions cut away of the vacuum cleaner illustrated in FIG. 1.

Turning to FIG. 2, the vertical front wall or exterior face 20*a* of the fan casing 20 is more clearly shown, the nozzle 16 having been removed from engagement with the motor housing 12. The exterior face 20*a* provides a pivot bar structure 26 of a known type whose ends pivotally support the particular work attachment engageable with exterior face 20*a* of the fan casing 20. An aperture in the central area of the exterior face 20*a* provides access to a chamber-contained rotary fan 21 whose mid-portion includes the outwardly extending drive shaft 31, the fan being rotated to pull air into the fan casing 21 for exhaust via the tangential outlet (not shown).

With reference to FIG. 3 (taken in conjunction with FIG. 2), wherein the nozzle 16 is shown in its mounted position on the exterior face 20*a* of the fan housing 20, a pair of adjustable wheels 24 space the fan casing 20, and thus the nozzle 16, a predetermined distance from the floor or other supporting surface as determined by a foot-actuated pedal 24*a*. Other wheels 24 (see FIG. 1) at the rear of the housing 12 further support the vacuum cleaner 10 so that it can be rolled back and forth by a user over a surface. As noted above, the nozzle 16 is of a known type and includes a pair of spaced support arms (not shown) that engage and pivotally ride on the pivot bar structure 26. With the nozzle 16 supported by the pivot bar, it pivots up against exterior face 20*a* and is locked in place by a suitable latch mechanism 17. A conventional suction regulating vent 16*a* for the nozzle 16 can be adjusted by the user to vary the amount of suction force generated at the lower portion of the nozzle engageable with, for example, a deep pile carpet (less suction) or a lighter pile carpet (more suction).

In accordance with the present invention and with particular reference to FIG. 2, lever structure 40 is mounted against the face 20*a* of the fan casing 20. The cranklike lever structure 40 includes a housing 41 formed, for example, by injection molding of plastic material. The housing contains a cranklike element (shown in phantom) formed, for example, of bent wire. The cranklike element includes a linear intermediate linkage portion 42 that can rotatably oscillate back and forth to a limited extent on a longitudinal axis A—A, the upper end of the intermediate portion 42 providing a contact paddle 43 (extending at right angles to axis A—A), the other or lower end of the linkage portion 42 providing a crank arm 44 (also extending at right angles to axis A—A). As shown in FIG. 3, the nozzle 16 includes a suction conduit 15 of tubular configuration that mates in generally sealing engagement against the central aperture in the exterior face 20*a* of the fan casing 20, the conduit 15 including along its side a speed switch actuating lug portion 15*a* that engages the contact paddle 43 so as to rotate the intermediate linkage portion 42 on the axis A—A a predetermined degree when the nozzle 16 is fully engaged in position against the exterior face 20*a*. As shown in FIG. 3, the lug portion 15*a* can assume numerous positions. A safety position (illustrated in phantom farthest from the face 20*a*), is realized when the nozzle 16 is unlocked and pivoted away from the face 20*a*. In this condition, the lug 15*a* disengages from the contact paddle which, under spring biasing, pivotally moves away from the face 20*a* wherein an associated motor-energizing switch (to be subsequently illustrated) establishes an open circuit condition to preclude operation of the vacuum cleaner motor when the nozzle 16 is not locked in its proper position or is removed. The nozzle 16 is illustrated in its retained position with the lug 15*a* being slightly spaced from the front wall 20*a* of the casing 20 and engaging the contact paddle 43 (FIG. 2). In this low speed position, the engaged paddle 43 has been moved a predetermined degree toward the exterior face 20*a* so as to cause the vacuum cleaner to operate in a low speed mode. Other attachments (not illustrated) interchangeable with the nozzle 16 would require a high speed vacuum cleaner mode wherein the lug 15*a* (constituting a part of every attachment) would move the contact paddle 43 further towards the face 20*a*, wherein the motor-energizing switch would be in another motor-energizing condition. The vacuum cleaner motor would then operate in a high speed mode.

Figure 4:
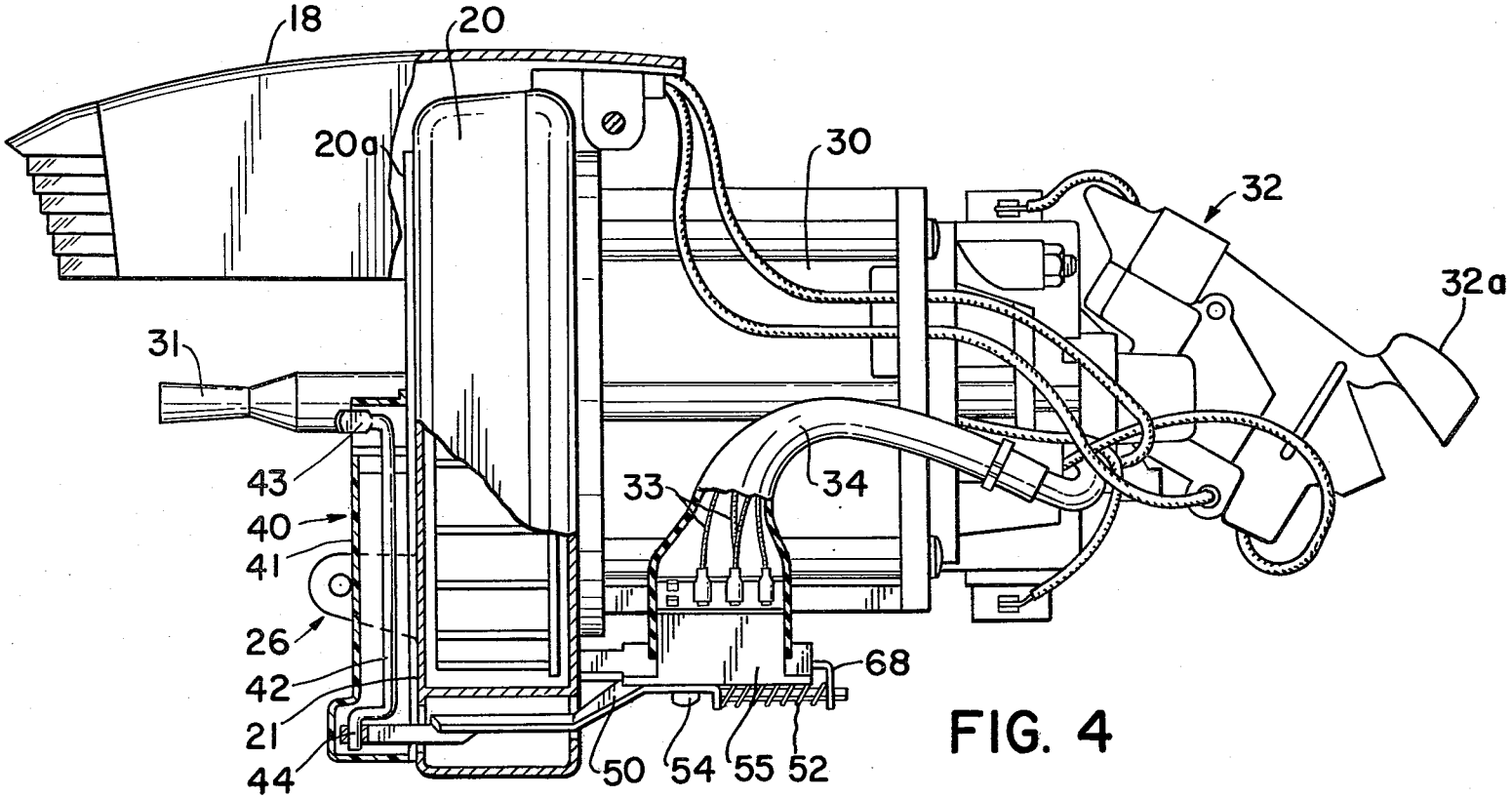
FIG. 4 is an elevational view with portions cut away of the vacuum cleaner housing illustrated in FIGS. 1 and 2.

In order to establish a high speed or low speed mode of operation for the vacuum cleaner, the crank arm 44 pivotally engages with one end of a elongated metal arm element 50 illustrated in FIG. 4. The elongated arm element 50 passes freely through the front wall of the casing 20 providing the face 20*a*. The element 50 moves linearly and axially back and forth or, as viewed in FIG. 4, from left to right to actuate a speed selector switch 55 constituted in the present invention by a conventional multiposition, double pole slide switch. This switch type preferably has a solid button 54 of electrical insulating material so as to totally isolate the metal element 50 from the switch contacts. The solid button 54 is also preferred because of its structural strength as opposed to a hollow button. The slide switch 55 includes fixed contacts and one or more movable contacts, the movable contacts being fixed in relation to and movable by the electrically insulating button 54 engaged and retained by the elongated element 50 in a manner to be subsequently described. A plurality of power leads 33, electrically insulated by a rubberlike boot 34, extend from the switch 55 to a conventional on-off switch mechanism 32, switch 55 and the on-off mechanism 32 operating together to energize to a predetermined degree a two-speed suction motor 30 for driving the fan 21 and drive shaft 31 contained within the fan housing 20.

As viewed in FIG. 4, wherein an attachment such as a nozzle 16 is not connected to the fan housing 22, a biasing spring 52, having one end fixed in position and the other end bearing against a portion of the arm element 50, forces the elongated arm element 50 leftwardly wherein the paddle 43 is spaced at its maximum distance from the exterior wall 20*a* of the housing 20, the distal end of the crank arm 44 being received within a bushinglike aperture at the leftward end of the elongated arm element 50. It can be seen that the insulated button 54 of the switch is moved to a far leftward position. In this condition, with the vacuum cleaner connected to a source of power, tripping of the conventional foot-operated on-off switch pedal 32*a* by the user will not cause energization of the motor 30, since the switch 55 is in an open circuit condition so as to preclude unsafe operating conditions. Thus, the shaft 31 and the fan 21 will not rotate so as to expose the user to their rotating portions.

When an attachment is locked in position against the face 20*a* with the attachment being supported on the pivot bar structure 26, the paddle 43 will be moved inwardly to a low speed position or to a high speed position (by lug 15*a*—FIG. 3). In the low speed position, the paddle 43 is moved approximately half the distance to the front face 20*a* wherein the cranklike arm end 44 linearly moves the elongated arm element 50 rightwardly as viewed in FIG. 4, wherein the button 54 of the switch 55 moves to a center position, the stator winding of the motor 30 then being connected in a low speed configuration wherein actuation of the on-off switch 32 by the pedal 32*a* energizes the motor for running at a slow speed. If the attachment mounted to the front face 20*a* requires a high speed operation, the associated switch-actuating lug 15*a* engageable with the contact paddle 43 will move the paddle against the face of the biasing spring 52 all the way or nearly all the way up to the face 20*a* wherein the element 50 will be moved to a far rightward position. The button 54 also moves to its far rightward position to place the motor stator winding in a high speed winding configuration, the spring 52 being compressed to its maximum extent. When the switch mechanism 32 is actuated, the motor 30 will run at high speed.

When an attachment is removed from the front face, the contact paddle 43 is released and the spring 52 forces the element 50 and the switch button 54 back to their far leftward positions, as illustrated in FIG. 4, so as to once again preclude inadvertent energization of the motor 30 without an attachment being positioned properly on the fan case 20.

Figure 5:
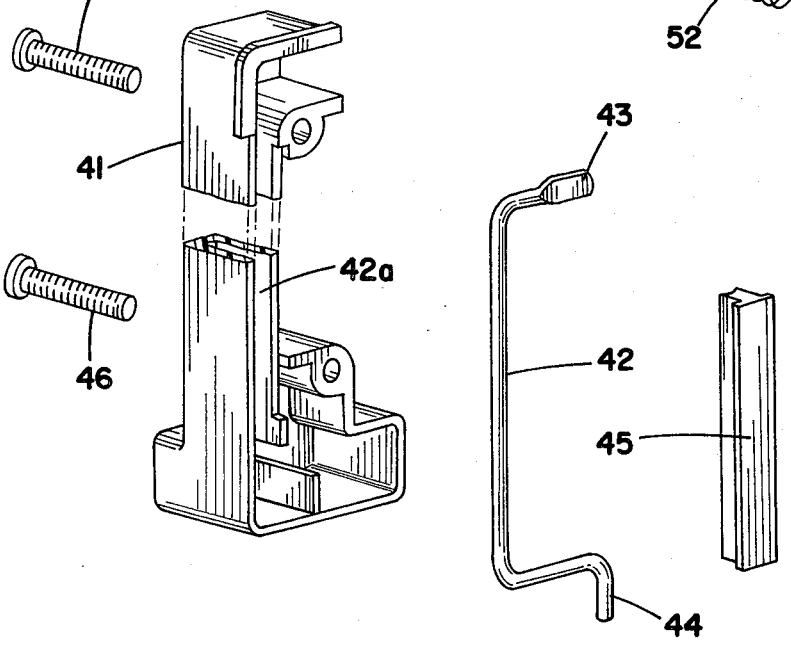
FIG. 5 is an exploded perspective view of a portion of an electrical switch mechanism in accordance with the present invention.

With reference to FIG. 5, there is illustrated in detail the means constituting the lever structure 40 illustrated and discussed with regard to FIGS. 2, 3 and 4. The lever elements housing 41 includes a channel 42*a* which loosely receives and rotatably supports for oscillatory movement the intermediate linkage portion 42 pivotal on the axis A—A (FIG. 2). The intermediate linkage portion 42 is loosely held in position within the channel 42*a* by a suitable retainer 45 also formed of plastic, the retainer 45 being forced into an interference fit within the channel 42*a*. It can be seen that the intermediate portion 42 and the crank arm 44 are completely contained within the housing 41 which is fastened against the exterior face 20*a* of the case 20 (FIGS. 2, 3 or 4) by a pair of screws 46 threaded into the exterior face 20*a*.

Figure 6:
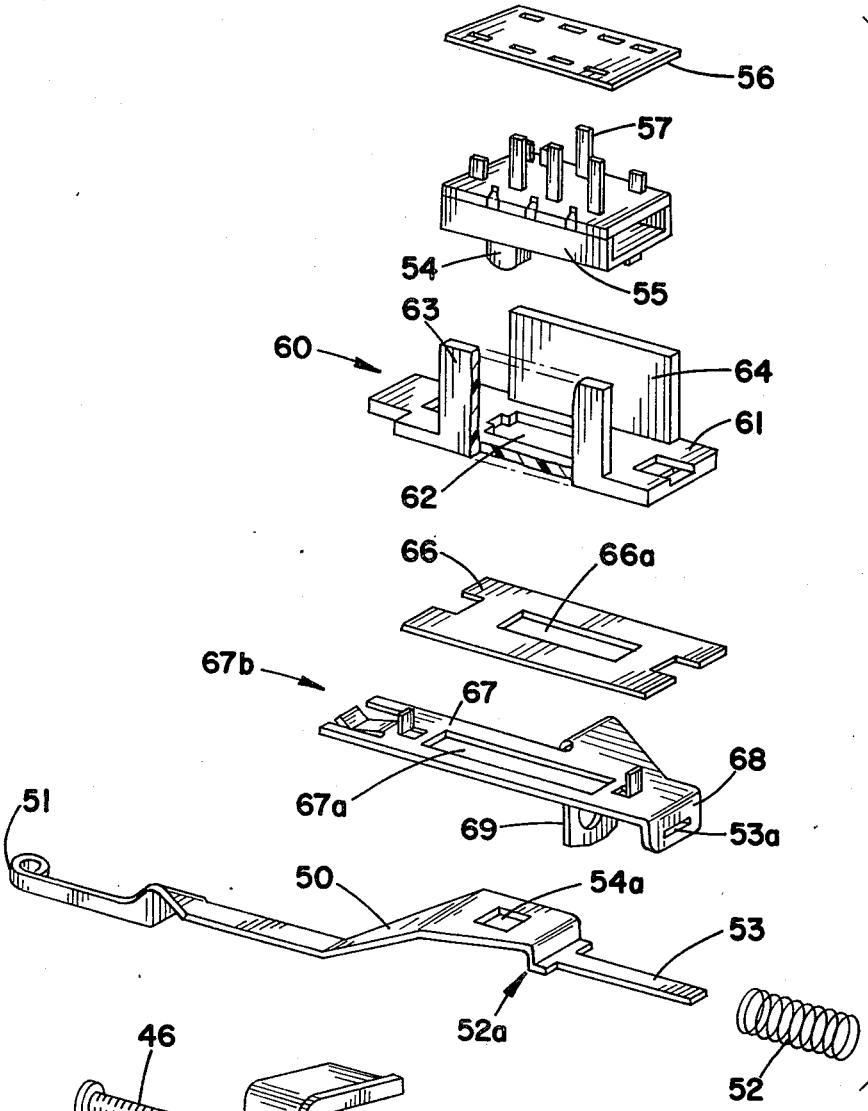
FIG. 6 is an exploded perspective view of another portion of the electrical switch mechanism in accordance with the present invention.

With reference to FIG. 6, the elongated arm element 50 is more clearly illustrated as being generally linear with a plurality of bent portions, the element 50 preferably formed from a narrow strip of sheet metal that is stamped and punched. The leftward end of the elongated arm element 50, as viewed in FIG. 6 (and as viewed in FIG. 4), includes a bushing portion 51 which pivotally receives the distal end of the crank arm 44 (FIG. 5). The elongated arm element 50 further includes an aperture 54*a* sized to receive the button 54 of the switch 55, wherein the button 54 and the link 50 move together in accordance with movement of the contact paddle 43 (FIG. 5). As shown in FIG. 6, a conventional insulator 56 slips down over double pole switch contacts 57 to insulate the internal structure of the switch from the power leads 33 (FIG. 4) connected to the contacts 57. The switch 55 with its button 54 is received by and supported by a switch retaining bracket 60 formed of plastic material having electrical insulating properties and having a base portion 61 and a pair of upwardly extending parallel spaced legs 63 and 64. An aperture 62 in the base portion 61 of the bracket 60 permits extension through it of the button 54. A switch mounting bracket 67 supports the switch retaining bracket 60, the brackets 60,67 being separated by a rubber insulating gasket 66. The gasket 66 also includes an aperture 66*a* as does the bracket 67 contain an aperture 67*a*, both apertures 66*a*,67*a* functioning to permit extension of the switch button for engagement with and locking into the aperture 54*a* of the elongated arm element 50. The rearward portion of the bracket 67 provides a downwardly extending tab 68 having a slot 53*a* which slidably receives the rearward end 53 of the elongated arm 50. The tab 68 constitutes a fixed stop against which one end of the spring 52 bears. The spring 52 is slid over the end 53 (as illustrated in FIG. 4) of the element 50 and engages a stop portion 52*a*, the spring 52 thus being trapped between the relatively fixed tab 53*a* and the movable stop portion 52*a*. A mounting tab 69 provided by a bracket 67 is fastened by a screw or the like to the frame of the motor 30 or other suitable support structure, the forward portion 67*b* of the mounting bracket 67 being received and retained with a suitable recess in the rearward portion of fan casing 20.

It can be seen from the foregoing drawing figures that the vacuum cleaner 10 has a casing 20 that provides the exterior face 20*a* for supporting a removable work attachment, such as nozzle 16, that operates in conjunction with the electric motor 30 contained within the casing 22. An electrical switch mechanism for regulating energization of the motor 30 is constituted by the cranklike lever structure 40, the elongated arm element 50 and the switch 55 along with the corresponding mounting brackets and associated elements. With the power leads 33 connected to the switch 55 as illustrated, the electrically insulating jacket or boot 34, slipped completely over the rearward contact portion of the switch 55, covers the leads 33 and the back of the switch 55 completely isolates the terminal 33 and switch contacts 57 from dirt and dust. Further, the plastic bracket 60 and the rubber insulating gasket 66 aid in electrically isolating the switch contacts from conductive metal parts of the vacuum cleaner. By using the linkage means, e.g., elements 40 and 50, no electric power leads have to pass through the front wall 20*a* of the housing as was the practice in the prior art, thus eliminating a potential shock hazard to the user. Further, the switch means in the preferred form of the conventional slide switch 55 is mounted within the housing 12 of the vacuum cleaner 10 so as to protect it from dirt and dust that might otherwise contaminate it if it were mounted exteriorly of the housing. Since the switch 55 is a conventional over-the-counter item and since the other linkage and bracket parts of the assembly are of simple design, the cost of the switch assembly in accordance with the invention is low. Also, the components of the switch mechanism are easy to assemble with no special tools being required.

It should be evident that this disclosure is by way of example and the various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. In a vacuum cleaner having a housing providing an exterior face for supporting a removable work attachment operable in conjunction with an electric motor contained within the housing, an electrical switching mechanism for regulating energization of the motor comprising:

a switch means having fixed and movable contacts, the switch means being mounted within the housing and being electrically connected to the motor; and a linkage means connected to the movable contacts of the switch means and passing through a wall of the housing for engagement with the work attachment, the position of that portion of the work attachment engageable with the linkage means determining the position of the switch means wherein the state of energization of the motor is dependent on the position of the switch means.

2. An electrical switching mechanism according to claim 1 including biasing means engageable with the linkage means to bias it at a position wherein the switch means movable contact connected to the linkage means is in an open circuit condition to preclude energization of the motor without a work attachment mounted to the housing.

3. An electrical switching mechanism according to claim 1, wherein the switch means is constituted by a multiposition slide switch having a body portion providing fixed contacts and a movable slide portion providing at least one movable contact, the slide portion including a solid button-like projection composed of electrical insulation material, the linkage means being connected to the buttonlike projection wherein the linkage means is electrically isolated from the contacts of the slide switch.

4. In a vacuum cleaner having a housing providing an exterior face for supporting a removable work attachment operable in conjunction with an electric motor contained within the housing, an electrical switching mechanism for regulating energization of the motor comprising:

a multiposition slide switch mounted within the housing and spaced from its inner walls having fixed and movable contacts and the slide switch being electrically connected to the motor to control its state of energization; and a biased linkage connected between the switch and the exterior face for supporting a work attachment, the linkage passing freely through a wall of the housing, the work attachment, when positioned against and supported by the exterior face, engaging the linkage to move it from its normal biased position to another position, the slide switch moving with the linkage to establish a state of energization of the motor.

5. An electrical switching mechanism according to claim 4, wherein the linkage includes an elongated arm element translationally movable back and forth along its longitudinal axis, the arm element having one end portion connected to the movable contacts, the other end portion of the arm element extending through a wall of the housing to the exterior thereof.

6. An electrical switching mechanism according to claim 5, wherein the linkage includes a cranklike lever element pivotally mounted to the exterior face for supporting the work attachment, one end of the lever element being connected to the said other end of the arm element, the other end of the lever element being engageable with the removable work attachment when mounted on and supported by the exterior face.

7. An electrical switching mechanism according to claim 5 or 6 including a spring connected between the movable linkage and a fixed point, the spring being compressed to bias the linkage at one extent of its travel.

8. An electrical switching mechanism according to claim 7, wherein the spring is located within the housing and is spaced from its interior walls.

* * * * *